US008100201B2

(12) United States Patent
Borissov

(10) Patent No.: US 8,100,201 B2
(45) Date of Patent: Jan. 24, 2012

(54) ROTARY DRILL BIT

(75) Inventor: Anatoli Borissov, Sugar Land, TX (US)

(73) Assignee: BlueFire Equipment Corporation, Houston, TX (US)

( * ) Notice: Subject to any disclaimer, the term of this patent is extended or adjusted under 35 U.S.C. 154(b) by 187 days.

(21) Appl. No.: 12/509,202

(22) Filed: Jul. 24, 2009

(65) Prior Publication Data

US 2010/0018771 A1 Jan. 28, 2010

Related U.S. Application Data

(60) Provisional application No. 61/083,741, filed on Jul. 25, 2008.

(51) Int. Cl.
*E21B 10/42* (2006.01)
*E21B 10/46* (2006.01)
*E21B 10/61* (2006.01)

(52) U.S. Cl. ..... 175/339; 175/393; 175/425; 175/428; 175/429; 175/434

(58) Field of Classification Search ..... 175/57, 175/391, 393, 329, 410, 398, 429, 412, 419, 175/418, 306, 417, 296, 371
See application file for complete search history.

(56) References Cited

U.S. PATENT DOCUMENTS

| | | | | |
|---|---|---|---|---|
| 4,246,977 | A | 1/1981 | Allen | |
| 4,323,130 | A | 4/1982 | Dennis | |
| 4,391,339 | A | 7/1983 | Johnson, Jr. et al. | |
| 4,452,324 | A | 6/1984 | Jurgens | |
| 4,460,053 | A | 7/1984 | Jurgens | |
| 4,540,055 | A | 9/1985 | Drummond et al. | |
| 4,540,056 | A | 9/1985 | O'Hanlon | |
| 4,582,149 | A | 4/1986 | Slaughter, Jr. | |
| 4,606,418 | A * | 8/1986 | Thompson | 175/429 |
| 4,640,374 | A | 2/1987 | Dennis | |
| 4,830,124 | A * | 5/1989 | Zijsling | 175/393 |
| 4,848,476 | A | 7/1989 | Deane et al. | |
| 4,989,680 | A | 2/1991 | Deane et al. | |
| 5,230,389 | A | 7/1993 | Besson | |
| 5,417,296 | A | 5/1995 | Murdock | |
| 5,595,252 | A | 1/1997 | O'Hanlon | |
| 5,699,868 | A | 12/1997 | Caraway et al. | |
| 6,253,864 | B1 * | 7/2001 | Hall | 175/415 |
| 6,474,423 | B1 | 11/2002 | Wood | |
| 6,581,702 | B2 | 6/2003 | Dickey | |

* cited by examiner

*Primary Examiner* — William P Neuder
*Assistant Examiner* — Ronald Runyan
(74) *Attorney, Agent, or Firm* — Streets & Steele

(57) ABSTRACT

A rotary drill bit (10) is provided for drilling a hole in a subsurface formation. The bit body (12) includes a plurality of axially extending ribs (16*a, b, c* and *d*) and a flow channel between adjacent ribs. A plurality of cutting elements are fixedly mounting on a respective one of the plurality of ribs. A plurality of flow nozzles (20*a, b, c* and *d*) direct fluid to a respective one of the plurality of cutting elements to clean and cool the cutting elements.

12 Claims, 4 Drawing Sheets

ROTARY DRILL BIT

CROSS-REFERENCE TO RELATED APPLICATION

This application claims the priority of U.S. Provisional Application No. 61/083,741 filed on Jul. 25, 2008, the disclosure of which is incorporated herein by reference for all purposes.

FIELD OF THE INVENTION

The present invention relates to a rotary drill bit for drilling a hole in a subsurface formation. More particularly, the invention relates to a rotary drill bit which includes a plurality of cutting elements each mounted on a respective one of a plurality of radially extending ribs, and a plurality of flow nozzles for directing fluid to a respective one of the cutting elements.

BACKGROUND OF THE INVENTION

Rotary drill bits are commonly used to drill in a formation by cutting the soil or rock. Drilling mud is used to control subsurface pressures, lubricate the drill bit, stabilize the well bore, and carry the cuttings to the surface. Mud is pumped from the surface through the hollow drill string, exits through nozzles in the drill bit, and returns to the surface through an annulus between the drill string and the interior wall of the hole.

As the drill bit grinds rocks into drill cuttings, these cuttings become entrained in the mud flow and are carried to the surface. Prior to returning the mud to the recirculating mud system, the solids are separated from the mud. The first step in separating the cuttings from the mud commonly involves circulating the mixture of mud and cuttings over shale shakers. The liquid mud passes through the shaker screens and is recirculated back to the mud tanks from which mud is withdrawn for pumping downhole. The vibratory action of the shakers moves the cuttings down the screen and off the end of the shakers, where they are collected and stored in a tank or pit for further treatment or management. Often two series of shale shakers are used. The first series (primary shakers) use coarse screens to remove only the larger cuttings. The second series (secondary shakers) use fine mesh screens to remove much smaller particles.

Additional mechanical processing is often used in the recirculating mud system to further remove fine solids because these particles tend to interfere with drilling performance. This separation equipment may include one or more of three types: 1) hydrocyclone-type desilters and desanders, 2) mud cleaners (hydrocyclone discharging on a fine screened shaker), and 3) rotary bowl decanting centrifuges. The separated fine solids are typically combined with the larger drill cuttings removed by the shale shakers.

Rate of penetration (ROP) of the drill bit is a major characteristic for wells, and often a critical cost issue for deep wells. Low ROP in the order of 3-5 feet per hour is commonly the result of the high compression strength of formations encountered at the greater depths, and the ineffectiveness of the cutting bit.

Subterranean drill bits can be used in many different applications, such as oil and gas exploration, mining, construction, and geothermal. There are two main types of drill bits. A roller bit uses steel teeth or tungsten carbide inserts mounted with one, two, or three moving rollers. Tricone bits with hardened inserts are used for drilling hard formations at both shallower depths and deeper depths. However, at greater depths it is more difficult to recognize when a tricone bit's bearings have failed, a situation that can occur with greater frequency when greater weight is applied to the bit in a deep well. This can lead to more frequent failures, lost cones, more frequent trips, higher costs and lower overall rates of penetration.

Another type of cutter bit does not use any moving cutting mechanism. Fixed cutter bits with polycrystalline diamond compact (PDC) cutters employ synthetic polycrystalline diamonds bonded to a tungsten-carbide stud or blade. PDC bits typically drill several times faster than tricone bits, particularly in softer formations, and PDC bit life has increased dramatically over the past 20 years. PDC bits nevertheless have their own set of problems in hard formations. For example, "bit whirl" is a problem that occurs when a PDC bit's center of rotation shifts away from its geometric center, producing a non-cylindrical hole. This can result from an unbalanced condition brought on by irregularities in the frictional forces between the rock and the bit. PDC bits are also susceptible to "stick slip" problems where the bit hangs up momentarily, allowing its rotation to briefly stop, and then slips free to rotate at a high speed. While PDC cutters are good at shearing rock, they are susceptible to damage from sharp impacts that lead to problems in hard rocks, resulting in reduced bit life and lower overall rates of penetration. PDC bit designs frequently include features that attempt to address these problems, namely, force balancing, spiraled or asymmetric cutter layouts, gauge rings, and hybrid cutter designs. Nevertheless, PDC bits frequently have significant shortcomings, particularly when drilling in extreme environments.

In a conventional drill bit, the mud flows from one or several nozzles for clearing and cooling the cutters. The mud jet is commonly directed straight from the nozzle to the base of drilling bore (dome). Such flow of the mud causes numerous disadvantages. First, the jet entrains the drill cuttings or solids, and brings them to the bottom of borehole. When drill cuttings go back up to the drill bit cutters, they erode the bits. Another disadvantage it that heat is not appropriately transferred from the bit's cutter to the mud, due to lower speed of the mud flow through the debris slots in the bit. This causes a large heat stress on the cutters thus reducing their rigidity, which in turn reduces the rate of penetration and the operating hours for the drill bit.

U.S. Pat. No. 6,142,248 to Thigpen et al. discloses a method to reduce nozzle erosion using a nozzle which supplies the mud in the laminar flow regime. An enhanced hydraulic design (Mudpick II) plays a key role in the bit performance. The mud stream is directed first to clean the cutters and then it sweeps under a cutter at the point of formation contact for efficient chip removal. The jet path from the nozzle expands and meets the teeth on a roller cone, which commonly are not in the contact with the formation. The jet dissipates and loses hydraulic energy and does not provide the desired efficiency.

The disadvantages of the prior art are overcome by the present invention, and a new rotary drill bit and method of operating a drill bit are hereinafter disclosed.

SUMMARY OF THE INVENTION

In one embodiment, a rotary drill bit is provided for drilling a hole in a subsurface formation. The drill bit includes a bit body having a leading cutting face and outer peripheral edges. The bit body also includes a plurality of radially extending ribs with a flow channel between adjacent ribs, and also includes a bit body flow path radially inward of the peripheral edges. A plurality of cutting elements are each fixedly mounted on a respective one of the plurality of radially extending ribs. A plurality of flow nozzles each in fluid communication with a bit body flow path to direct fluid to a respective one of the plurality of cutting elements to clean and cool the cutting element.

These and further features and advantages of the present invention will become apparent from the following detailed description, wherein reference is made to the figures in the accompanying drawings.

DETAILED DESCRIPTION OF PREFERRED EMBODIMENTS

The present invention relates to improvements in drill bits which result in improved rate of penetration (ROP), increased working hours, and reduced requirements for the cutters. The present invention provides a significantly improved hydraulic system which manages the fresh fluid flow to each tooth of the drill bit. The operation of this downhole drill bit results in reduced thermal stresses at the cutter by an individual jet cooling each tooth, improved cleaning capability by supplying fresh fluid to the cutter, and reduced erosion of the cutters.

Figure 1:
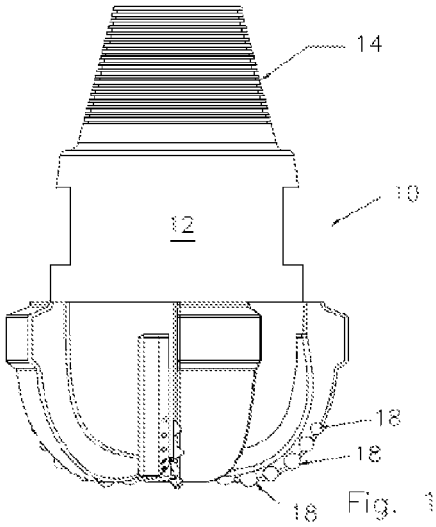
FIG. 1 illustrates a side view of one embodiment of a rotary bit according to the present invention.
Figure 2:
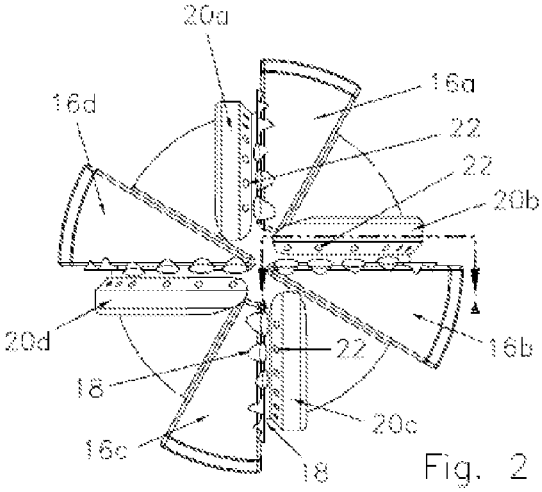
FIG. 2 is a bottom view of the drill bit shown in FIG. 1.

Referring now to FIG. 1, one embodiment of an improved rotary drill bit 10 is illustrated, comprising a bit body 12 with upper threads 14 for interconnection with a drill pipe or other tubular. Those skilled in the art will appreciate that box threads may be provided on the bit body rather than the pin threads. As shown in FIGS. 1 and 2, the drill bit includes four circumferentially spaced blades or ribs 16*a*, 16*b*, 16*c*, and 16*d*. Each of these ribs supports a plurality of cutting elements each fixed to a respective rib, such as cutting elements 18 shown in FIGS. 1 and 2. Each of the ribs or blades may have a generally curved triangular configuration, although other configurations may be provided for the radially extending ribs. The bit 16 may be provided with gauge cutters 19, which in many applications do not include PDC cutting elements.

Still referring to FIGS. 1 and 2, the drill bit includes a plurality of manifolds 20*a*, 20*b*, 20*c*, and 20*d*, with each manifold comprising a plurality of discharge ports or jets 22. As explained subsequently, each of the plurality of jets is beneficially directed toward a respective cutter to provide increased cooling and cleaning for a cutting element. A jet may be a hole through a wall of the manifold and into the interior of the manifold, or a desired size jet as an insert may be secured within a larger receiving hole in the manifold.

Figure 3:
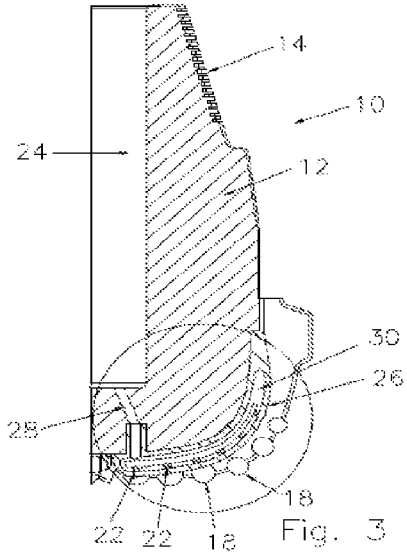
FIG. 3 is a cross-sectional view taken along lines 3-3 in FIG. 2.
Figure 4:
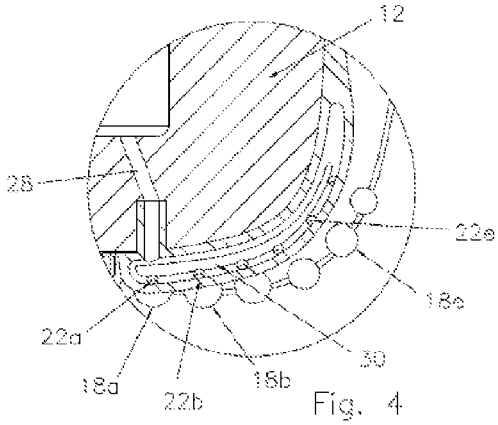
FIG. 4 is a detailed view of a portion of the bit shown in FIG. 3.

Referring now to FIG. 3, bit body 12 includes a central flow path 24 therein for supplying fluid to the cutters. For this embodiment, a manifold 26 is attached to the bit body, and a flow line 28 transmits drilling fluid from the flow path 24 to the interior of the manifold 26. The manifold 26 in turn includes a flow chamber 30 therein, with a plurality of discharge ports or jets 22 discharging fluid from the chamber 30 to a respective cutting element 18. FIG. 4 illustrates this feature in greater detail, with jet 22*a* being directed to cutter 18*a*, jet 22*b* being directed to cutter 18*b*, and jet 22*x* being directed to cutter 18*x*.

Those skilled in the art should appreciate that the drill bit includes a plurality of cutters on each rib, and a jet is positioned for directing drilling fluid to a respective one of the plurality of cutters on that rib. In one example, a rib may contain seven cutters and the manifold associated with that rib may contain seven jets, with each jet corresponding to a respective cutter. In other embodiments, however, more cutters than jets may be provided, so that one or more cutters may not have a jet specifically directed to that cutter. In yet other embodiments, a jet may be provided for each of the cutters on a rib, and another jet may be provided for removing debris in a desired manner from the bit, and is not directed to a specific cutter. A plurality of cutters are thus provided on each rib, and preferably four or more cutters are provided on each rib. Each of a plurality of cutters provided on a rib is provided with a respective jet, although additional cutters may not have jets, and additional jets may not have a corresponding cutter. In most applications, however, at least 3 or 4 cutters each supported on a rib will be supplied with fluid from a jet directed to that cutter.

For the embodiment as shown in FIGS. 1-4, each of the jets 22 provided on a manifold 20 are spaced approximately a uniform distance from a respective jet. This provides substantially equal fluid velocity from each jet to a respective cutter. For the embodiment as shown in FIGS. 5-8, a manifold is similarly provided for each rib, although in this instance each of the manifolds is spaced approximately equidistant between respective ribs.

Figure 5:
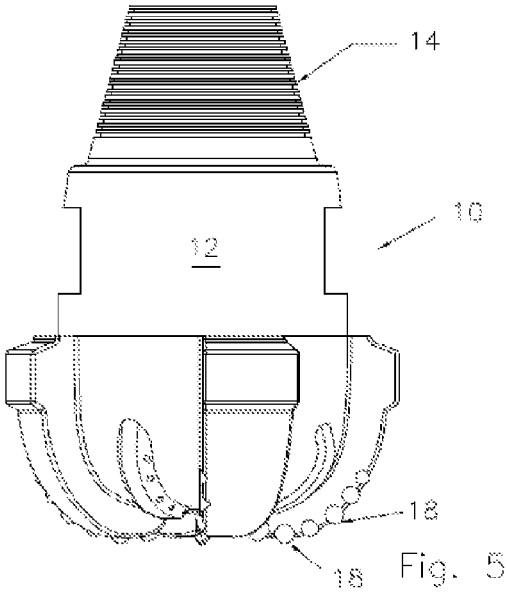
FIG. 5 is a side view of another embodiment of a drill bit.
Figure 6:
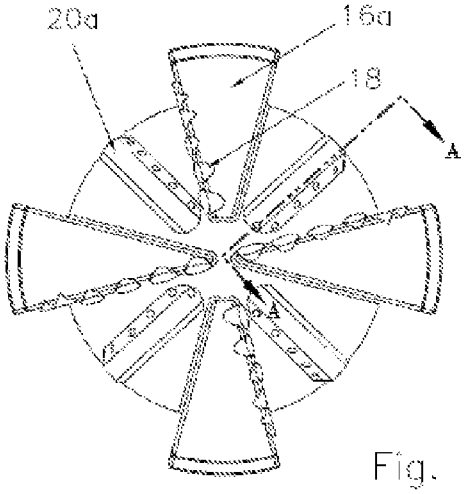
FIG. 6 is a bottom view of the drill bit shown in FIG. 5.

FIG. 5 discloses a drill bit 10 which is similar to the drill bit shown in FIG. 1, except that the jets in the manifold 20*a* are not spaced a uniform distance from the cutters 18 fixed to the rib 16*a*, and instead the spacing between a jet and a respective cutter increases as a function of the radially outward distance of the cutters and the jets from the centerline of the bit. As shown in FIG. 6, this allows the manifold to be spaced substantially equidistant between two ribs, which may provide for better flow of drilling fluids and solids into the annulus above the bit. The spacing between a jet and a respective cutter increases as the cutter spacing from the centerline of the bit increases, thereby increasing the washing area adjacent the cutters and improving removal of debris.

Figure 7:
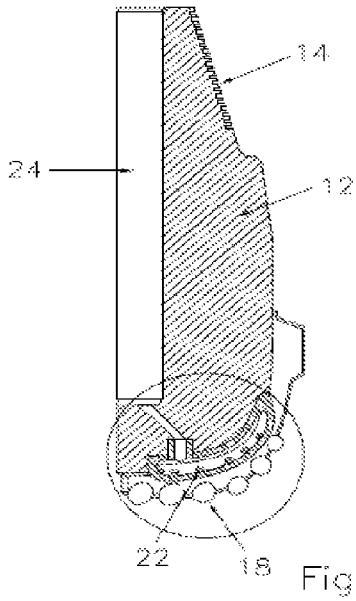
FIG. 7 is a cross-sectional view taken along lines 7-7 in FIG. 6.
Figure 8:
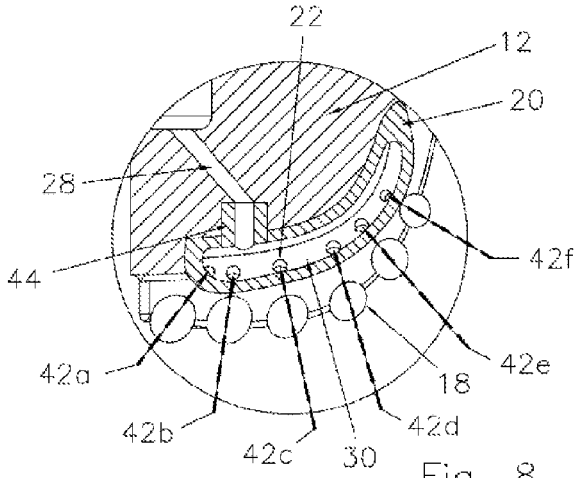
FIG. 8 is a detailed view of a portion of the bit shown in FIG. 7.

The cross-section of the drill bit as shown in FIG. 7 is similar to the cross-section of FIG. 3, except that the spacing between a jet 22 and a respective cutter 18 increases as the jet and the spacing move radially further outward along the rib. FIG. 8 shows that a central jet path from the central axis of the discharge port for each jet to the primary cutting surface on the face of the bit. The correlation between a jet and the respective cutter does not appear to be as clear for the previous embodiment since the cross-section is taken through the manifold, which is not parallel to the face of the cutters on a rib. Each jet central jet path 42*a*, 42*b*, 42*c*, 42*d*, 42*e*, 42*f* is illustrated in FIG. 8. Manifold 20 as shown in FIG. 8 includes an inlet port 44 for directing fluids into the interior of the manifold cavity. The manifold itself as shown in FIGS. 1 and 2 may be secured in various manners to the bit body, e.g., with bolts and/or welding.

Another way to distinguish the jets in a drill bit of this invention from the prior art relates to the high percentage of momentum of fluid from a specific jet which directly engages a primary cutting surface of a respective cutter. According to this invention, a high percentage of the fluid momentum from a jet is directed to a respective cutter which is highly beneficial to desired cooling and cleaning of a cutting element. The spacing between a jet and the respective cutter also is preferably less than 12 times the mean diameter of the jet discharge, and in many cases is 10 times or less the mean diameter of the jet discharge.

Figure 9:
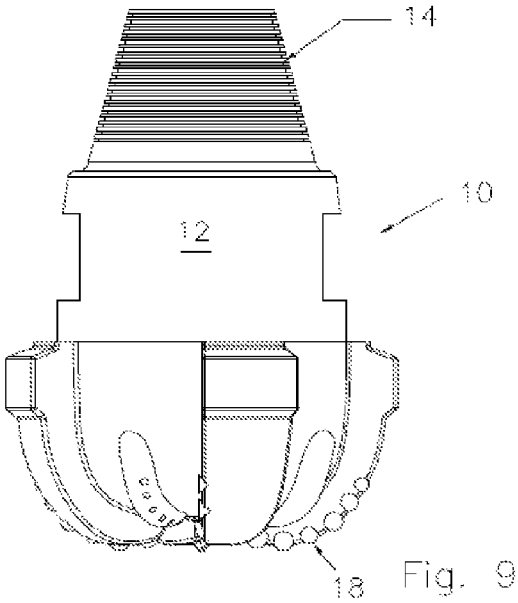
FIG. 9 is a side view of yet another embodiment of a drill bit.
Figure 11:
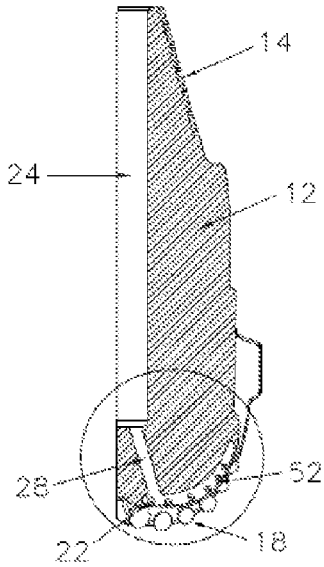
FIG. 11 is a cross-sectional view taken along lines 11-11 in FIG. 10.
Figure 10:
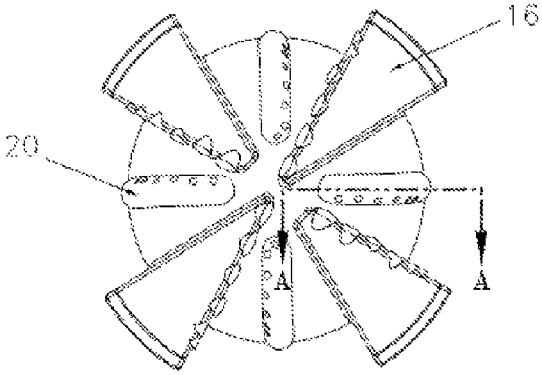
FIG. 10 is a bottom view of the drill bit shown in FIG. 9.
Figure 12:
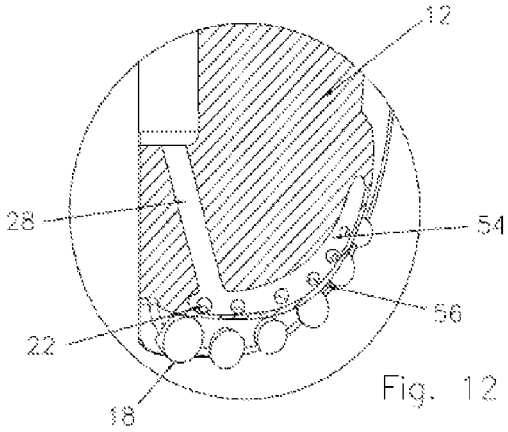
FIG. 12 is a detailed view of a portion of the bit shown in FIG. 11.

The drill bit 10 as shown in FIG. 9 is substantially similar to the FIG. 5 embodiment, with each manifold 20 being spaced approximately equally between a pair of ribs 16. As seen more clearly in FIG. 11, the cavity in the manifold 20 is formed directly in the bit body 12, with a cover plate 52 enclosing the manifold cavity. The manifold includes a plurality of jets 22 each for directing fluid to a particular cutter 18, as previously discussed. The flow path 28 in the manifold body supplies fluid from the central cavity 24 to the interior cavity in the manifold. FIG. 12 illustrates in further detail that the manifold includes an interior wall 54 of the bit body 12 or the interior wall of an insert which is generally fixed to the bit body 12. The radially outer cover 56 may also be part of insert or may be attached to the bit body by bolting or welding. Each of the jets 22 has fluid flow directed to a particular cutter, 18 as discussed for the prior embodiment. This built in design may also be used for the manifold positioned as shown in FIG. 1.

Figure 13:
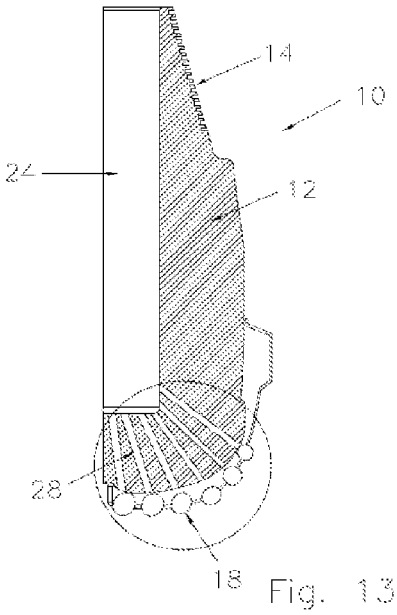
FIG. 13 is a cross-sectional view of another embodiment of a drill bit.
Figure 14:
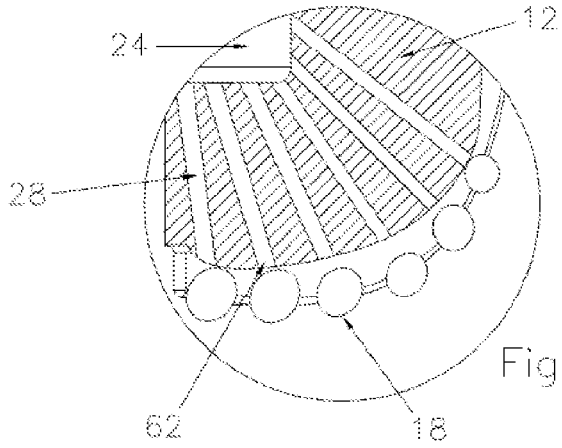
FIG. 14 is a detailed view of a portion of the bit shown in FIG. 13.

FIG. 13 is a cross-sectional view of yet another embodiment of a drill bit bit body 12 with a central flow path 24 therein, and a plurality of cutters 18 each affixed to a respective one of a plurality of circumferentially spaced ribs, as discussed above. This embodiment does not utilize a manifold, and instead a plurality of flow channels 28 each connecting the central flow path 24 to a respective jet, which in turn directs cooling fluid to a respective cutter 18. A plurality of cutters are conventionally provided on each rib, and FIG. 13 depicts a flow line 28 for each of the plurality of cutters, so that the six cutters as shown in FIG. 13 are each provided with a respective flow line 28 emanating from the central flow path 24. FIG. 14 shows in greater detail each of the flow paths 28 which has a discharge jet 62 at the discharge end thereof for directing a jet to a respective one of the cutters. The flow paths 28 may be provided in the bit body, or may be provided in an insert separate from and fixed to the bit body, so that the discharge ports are spaced from the rib supporting a respective cutter.

In the event that the drill bit were to become partially plugged, the drilling operator may lift the drill bit off the drilling surface and increase fluid pressure in the annulus so that fluid backwashes into the drill pipe, thereby flushing the flow paths and jets with fluid.

A method of drilling a hole in accordance with the present invention includes providing a bit body with a plurality of cutting elements each fixed to a respective one of a plurality of radially extending ribs, as discussed above. The method includes directing fluid from the bit body flow path to a plurality of flow nozzles each for directing fluid to a respective one of a plurality of cutting elements to clean and cool the cutting elements. A manifold may be provided for receiving fluid flow from a bit body flow path and outputting fluid through the plurality of flow nozzles, or the bit body may include a plurality of flow lines each extending from the bit body flow path to a respective one of the plurality of nozzles. Other features of the method of the invention will become apparent from the foregoing description.

The centerline of fluid flow from each nozzle is within 30° of a line passing through a central axis of the nozzle discharge port and a primary cutting surface on a respective cutting element, and in many applications this jet centerline is within 15° of a line passing through the nozzle central discharge port and a primary cutting surface, particularly when the jet discharge port is generally circular rather than being elliptical or slot-shaped.

As discussed above, the drill bit of the present invention includes a plurality of circumferentially spaced ribs, and each rib has fixedly mounted thereon a plurality of cutters. Larger diameter bits conventionally have more cutters, and also have a larger central flow path through the bit. According to the present invention, the mean diameter of the discharge port from each nozzle or jet is from about 3 mm to about 10 mm. In many applications, the mean distance of the discharge port will be from 3 mm to 8 mm. The hole diameter may increase for jets spaced radially outward from the bit centerline, particularly if the spacing between the jet and a respective cutter increases with this increased spacing. Each nozzle conventionally may have a circular discharge opening, but other configurations for an opening could be provided. In either event, the mean diameter of the opening is relatively small compared to prior art bits, since a discharge nozzle is preferably provided for cooling and cleaning one cutter, rather than a plurality of cutters.

The use of multiple fluid jets each directed to a respective cutter on the drill bit provides many benefits, such as improving the cleaning and scouring action, helping to remove the chip characteristics, and a better environment for the cutter and formation contact, which reduces the tooth wear, lubricates the teeth, provides uniform hydraulic balance for the drill bit, and reduces the "whirl" effect by providing more uniform cooling of the cutters and a cutting surface more uniformly affected by each of the plurality of cutters. The drill bit provides for cooling of an individual tooth, reducing the temperature of the cutter tip, and improving rigidity characteristics. These improvements increase the ROP, provide longer bit life, and allow for drilling longer intervals with no loss in ROP. A significant advantage of this invention is the reduction of erosion of the cutters as result of a substantial heat stress reduction and the reduction of the entrained drill cuttings in the mud moving past cutters at the point of formation contact by a jet, each achieved by supplying fresh fluid to each cutter.

Another advantage provided by this invention is the reduction of the heat stress on the cutters. In a conventional drill bit, mud first flows to the dome and on the return goes through the junk slots, which has a relatively large area. The mud velocity is thus small and consequently the coefficient of heat transfer is small compared with the present invention. Another advantage of this invention is that during the cutting process, each jet is helping to break the chips into smaller parts by applying hydraulic energy directly to the contact place between the primary cutting surface of a cutter and the formation. Better cleaning, cooling and lubrication of each individual cutter increases the rate of penetration and the operating hours for the drill bit.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A rotary drill bit for drilling a hole in a subsurface formation, comprising:

a bit body having a leading cutting face and outer peripheral edges, the bit body including a plurality of radially extending ribs with a flow channel between adjacent ribs, the bit body further including a bit body flow path radially inward of the peripheral edges;

a plurality of cutting elements each fixedly mounted on a respective one of the plurality of radially extending ribs;

a plurality of flow nozzles each in fluid communication with the bit body flow path for directing fluid to a respective one of the plurality of cutting elements to clean and cool the cutting element; and a manifold for receiving fluid flow from the bit body flow path and outputting flow through the plurality of flow nozzles to the respective plurality of cutting elements mounted on a respective rib, the manifold positioning each of the plurality of nozzles an increasing distance from a respective cutting element as a function of an increasing radial distance of a respective cutting element from a centerline of the bit.

2. A rotary drill bit as defined in claim 1, wherein the plurality of cutting elements each mounted on a respective blade include face cutting elements for defining the leading cutting face substantially perpendicular to a bit centerline and side cutting elements adjacent the outer peripheral edges of the bit body.

3. A rotary drill bit as defined in claim 1, wherein the manifold is provided for each of the plurality of radially extending ribs.

4. A rotary drill bit as defined in claim 1, wherein the manifold is attached to the bit body.

5. A rotary drill bit as defined in claim 1, further comprising:

a plurality of flow lines each extending from the bit body flow path to a respective one of the plurality of nozzles.

6. A rotary drill bit as defined in claim 1, wherein a centerline of fluid flow from each nozzle is within 30° of a line passing through a central axis of the nozzle discharge port and a primary cutting surface on a respective cutting element.

7. A rotary drill bit as defined in claim 1, wherein each nozzle has a mean diameter of from 3 mm to 10 mm.

8. The rotary drill bit as defined in claim 1, wherein a sidewall of the manifold is an insert attached to the bit body.

9. A method of drilling a hole in a subsurface formation, comprising:

providing a bit body having a plurality of radially extending ribs with a flow channel between adjacent ribs, the bit body further including a bit body flow path radially inward of its peripheral edges;

fixedly mounting a plurality of cutting elements on a respective one of the plurality of radially extending ribs;

providing a manifold for receiving fluid flow from the bit body flow path and outputting fluid through a plurality of flow nozzles to a respective plurality of cutting elements mounted on a respective rib, the manifold positioning each of the plurality of nozzles an increasing distance from a respective cutting element as a function of an increasing radial distance of a respective cutting element from a centerline of the bit; and providing a plurality of flow nozzles each in fluid communication with the bit body flow path for directing fluid to a respective one of the plurality of cutting elements.

10. The method as defined in claim 9, wherein the manifold is provided for each of the plurality of radially extending ribs.

11. The method as defined in claim 9, wherein a centerline of fluid flow from each nozzle is within 30° of a line passing through a central axis of the nozzle discharge port and a primary cutting surface on a respective cutting element.

12. The method as defined in claim 9, wherein each nozzle has a mean diameter of from 3 mm to 10 mm.

* * * * *